United States Patent [19]

Vadacchino et al.

[11] Patent Number: 4,984,835

[45] Date of Patent: Jan. 15, 1991

[54] STRIKE WITH RECTILINEARLY MOVABLE KEEPER LOCKING MEMBER

[75] Inventors: Joseph Vadacchino, Elmont, N.Y.; William L. Herron, Elizabeth, N.J.

[73] Assignee: Trine Products Corp., Bronx, N.Y.

[21] Appl. No.: 555,358

[22] Filed: Jun. 8, 1990

Related U.S. Application Data

[63] Continuation of Ser. No. 289,216, Dec. 23, 1988, abandoned.

[51] Int. Cl.[5] ..... E05C 19/16

[52] U.S. Cl. ..... 292/341.16; 292/144

[58] Field of Search ..... 292/341.16, 144, 201, 292/216

[56] References Cited

U.S. PATENT DOCUMENTS

| | | | |
|---|---|---|---|
| 419,766 | 1/1890 | Glaeser | 292/341.16 |
| 526,909 | 10/1894 | Pratt | 292/341.16 |
| 1,481,878 | 1/1924 | Palmer | 292/341.16 |
| 3,325,203 | 6/1967 | Moler | 292/201 |
| 3,521,921 | 7/1970 | Miyazaki | 292/341.16 |
| 3,638,984 | 2/1972 | Davidson | 292/341.16 |
| 3,749,435 | 7/1973 | Balzano | 292/341.16 |
| 3,910,617 | 10/1975 | Scalza et al. | 292/341.16 |
| 4,056,277 | 11/1977 | Gamus et al. | 292/341.16 |
| 4,088,354 | 5/1978 | Kolendowicz | 292/201 |
| 4,471,983 | 9/1984 | Bischoff et al. | 292/341.16 |

FOREIGN PATENT DOCUMENTS

| | | | |
|---|---|---|---|
| 26341 | of 1912 | United Kingdom | 292/341.16 |
| 352481 | 7/1931 | United Kingdom | 292/341.16 |

*Primary Examiner*—Eric K. Nicholson

*Attorney, Agent, or Firm*—Brooks Haidt Haffner & Delahunty

[57] ABSTRACT

An electrically operable strike with a pivotable keeper and a rectilinearly slidable locking member with arms which in one position of the locking member prevent pivoting of the keeper and which in a second, different position of the locking member, permit the keeper to pivot. The locking member has a magnetic portion and is moved from one position to the other by the magnetic field of a pair of electrically energizable coils. By selection of the spacing of the arms, the strike can be either normally locking or normally unlocking. Two locking members can be used to convert the strike from normally locking to normally unlocking or one locking member with adjustable or removable arms can be used for such conversion.

15 Claims, 4 Drawing Sheets

STRIKE WITH RECTILINEARLY MOVABLE KEEPER LOCKING MEMBER

This application is a division of application Ser. No. 289,216, filed Dec. 23, 1988 now abandoned.

BACKGROUND OF THE INVENTION

The invention relates to a strike used to prevent the opening of an associated access obstructing member, such as a door.

Electrically operable strikes are well known in the art, and for example, they are used frequently in connection with the main access door of an apartment building to prevent entry into the building until a solenoid associated with the strike is electrically energized to permit pivoting of the strike keeper. See, for example, U.S. Pat. Nos. 4,471,983; 3,638 984 and 3,749,435. Normally, the solenoid is energized by means of a circuit completing switch remote from the strike.

It is also known in the art to prevent release of the latch or keeper of the strike and opening of the door by electrically energizing the solenoid. However, usually there are substantial differences between the components of a strike which will release the keeper with energization of the solenoid and the components of a strike which will lock the keeper with energization of the solenoid.

In addition, the known strikes usually require several components, such as pivotable levers, etc. which increases the assembly problems and the likelihood of malfunctioning because of misalignment, binding or corrosion. Also, if opening force is being applied to the door, the solenoid generally will be unable to cause release of the keeper and/or the components may be unable to prevent opening of the door if a sufficient opening force is applied to the door due to breaking or bending of the locking components.

In general, prior art strikes comprise a single solenoid which has a winding of a conductor which, when electrically energized, actuates a centrally disposed armature which has a locking member connected thereto and biassed by a spring so that the keeper prevents pivoting of the locking member unless the solenoid is electrically energized. To keep the energizing current low, the biassing spring usually has a force which is only slightly more than the force required to return the locking member and the armature to their locking or unlocking positions. Such spring return force may, at times, such as with misalignment of parts, accumulation of foreign matter, etc., be insufficient to return them to their unlocking or locking positions.

It is also known in the art to use an air actuated piston and cylinder assembly with the piston connected to the locking member to actuate the locking member.

OBJECTS OF THE INVENTION

One object of the invention is to provide a strike of simplified construction.

Another object of the invention is to provide a strike which, by simple replacement of the locking device or simple modification of a single locking member, permits the strike to be changed from locking of the keeper with energization of the actuating means to unlocking of the keeper with energization of the actuating means.

Another object of the invention is to provide a strike construction which requires a force to break the locking member which is greater than the force required to break prior art locking mechanisms.

Another object of the invention is to provide a strike construction in which the locking member can be moved by the actuating means even if substantial force is applied to the keeper.

A further object of the invention is to provide a strike with an electromagnet and improved magnetic circuit for the electromagnet so that the locking member operating force for a given amount of electrical current is greater than in prior art strikes.

Other objects of the invention are to make assembly of the strike less critical and to provide a strike which operates equally as well in any orientation.

BRIEF SUMMARY OF THE INVENTION

The objects of the invention are attained in the preferred embodiment of the invention by pivotally mounting a keeper on a housing, such keeper having a pair of arms or lugs extending in planes perpendicular to the pivot axis, and by slidably mounting a locking member of magnetic material and having arms engageable with or spaced from the lugs on the keeper depending on the position of the locking member. The keeper is urged into its locking position by a spring, and the locking member is urged into the desired position, locking or unlocking, by a spring. The locking member bears against the housing so that any force applied thereto by the keeper is transmitted to a wall of the housing. A pair of electromagnet coils in the housing attract the locking member, causing it to move rectilinearly, when the coils are electrically energized.

In one embodiment of the invention, two locking members, one having said arms differently positioned from the arms of the other, are provided so that by the mere substitution of one locking member for the other, the keeper is normally locked or is free to pivot until the electromagnetic coils are energized.

In another embodiment of the invention, the locking member has four arms, two of which can be removed to cause it normally to lock or permit pivoting of the keeper until the coils are energized.

In a further embodiment of the invention, the arms of the locking member are adjustably mounted on the locking member so that by adjusting the positions of the arms, the keeper is normally locked or free to pivot.

BRIEF DESCRIPTION OF THE DRAWINGS

Other objects and advantages of the present invention will be apparent from the following detailed description of the presently preferred embodiments thereof, which description should be considered in conjunction with the accompanying drawings in which:

With reference to FIGS. 1–5, the preferred embodiment of the electrically operable strike 1 of the invention is illustrated in FIG. 1 as mounted in a recess of a door frame 11 associated with a door 2 having a latch 3 engaging a keeper 4 of the strike 1. The keeper 4 is pivotally mounted on the housing 5 by means of a pin or rod 6 secured at one end to the top wall 7 and at its opposite end to a tab 8 integral with the housing 5, the keeper 4 being pivotable around the pin 6. The housing 5 also has a pair of tabs 9 and 10 integral therewith for securing it to the door frame 11, such as by means of the screws 12.

Figure 1:
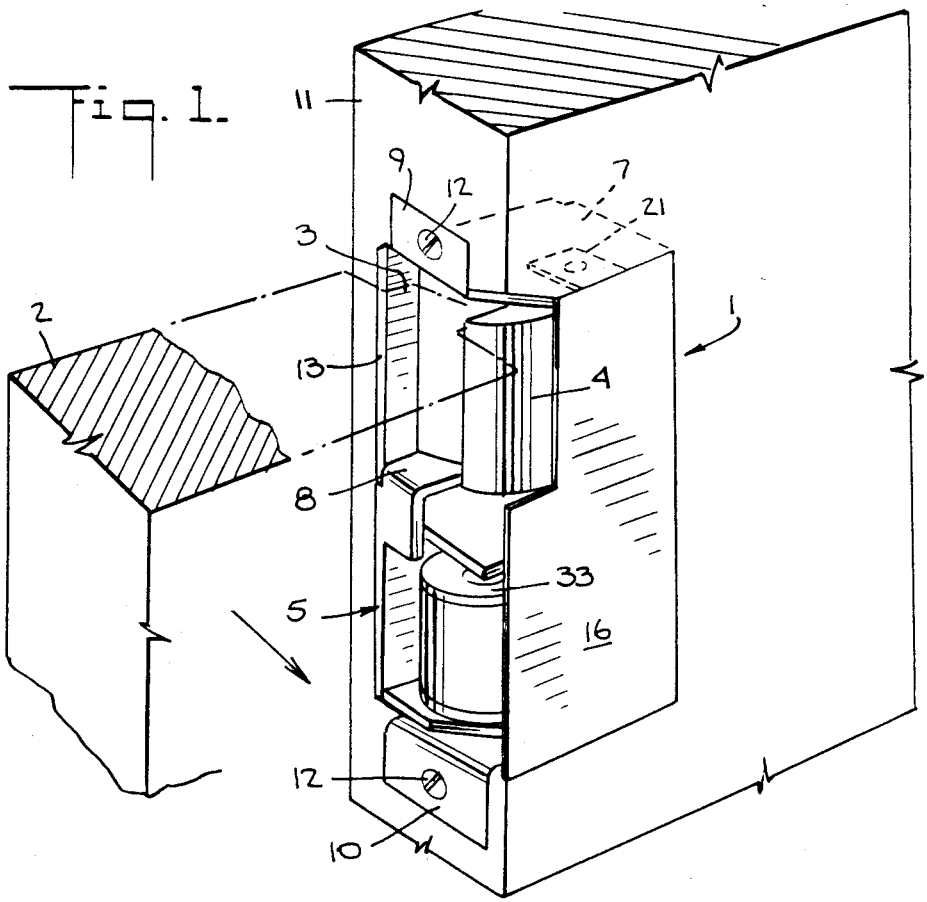
FIG. 1 is a perspective view of an embodiment of the electrically operable strike mounted on a door frame and a portion of a door controlled thereby.

The housing 5 has a side wall 13, a bottom wall 14, a rear wall 15 and a cover 16. The bottom wall 14 has a pair of slots 17 and 18 (see FIG. 5) for receiving arms 19 and 20 (see FIG. 4) at one end of the cover 16 which with a tab 21 at the opposite end of the cover 16 having a dimple 22 receivable in a recess 23 (see FIG. 4) in the top wall 7 releasably secure the cover 16 to the housing 5.

Figure 3:
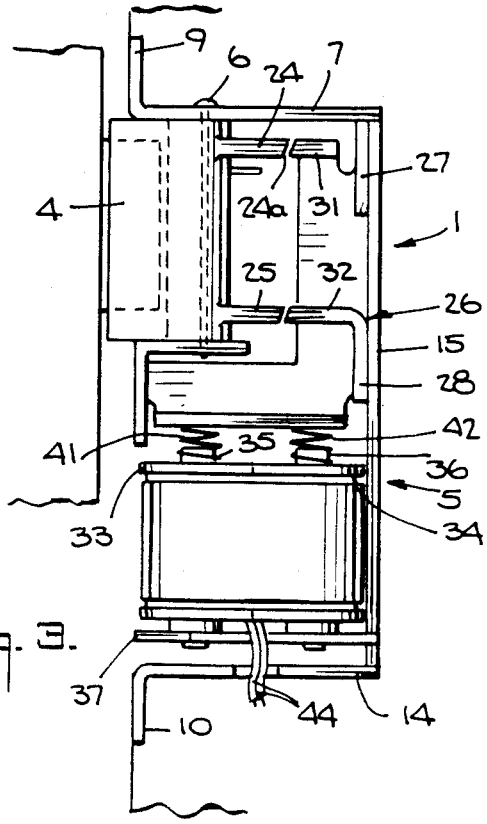
Figure 4:
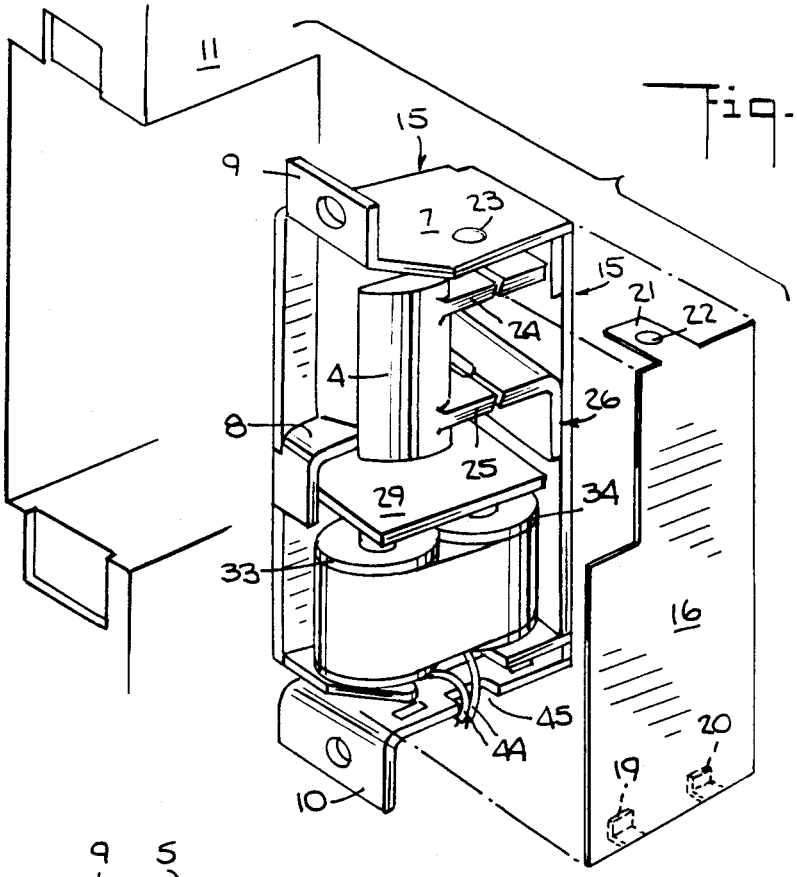
FIGS. 4 and 5 are, respectively, partly exploded and exploded perspective views of the strike shown in FIG. 1, the strike cover being omitted in FIG. 5.
Figure 5:
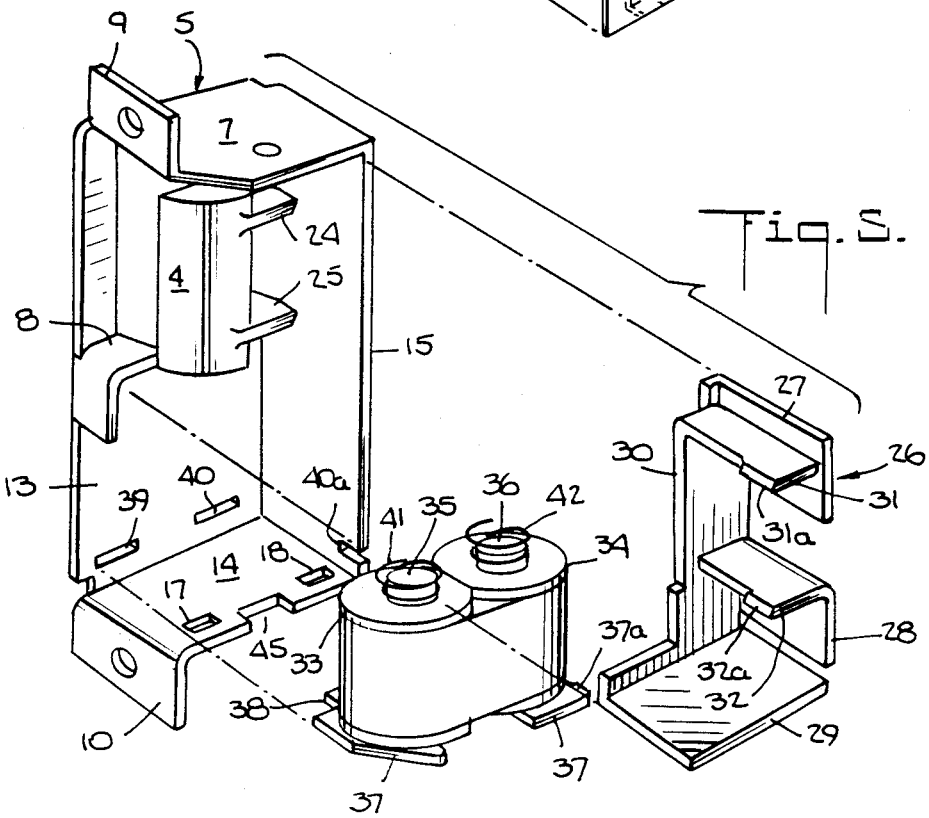

As seen in FIGS. 3–5, the keeper 4 has, at the rear thereof, a pair of lugs 24 and 25 extending perpendicularly to the axis of the pin 6. The lugs 24 and 25 are spaced apart in the direction of said axis by a predetermined distance, and although the end faces of the lugs 24 and 25 can be in planes perpendicular to the lengths of the lugs 24 and 25, for reasons set forth hereinafter, the lugs 24 and 25 preferably have bevelled end faces 24*a* and 25*a* (see FIG. 3).

Figure 2:
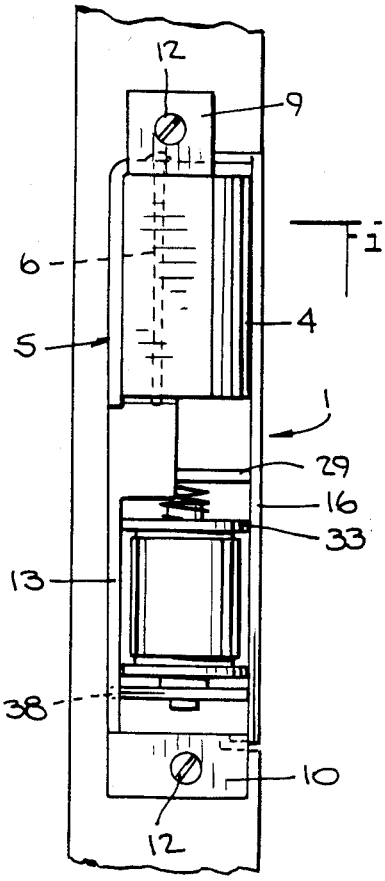
FIGS. 2 and 3 are, respectively, front and side elevation views of the strike shown in FIG. 1, the strike cover being omitted in FIG. 3.

A locking member 26 (see particularly FIG. 5) is slidably mounted in the housing 5 and has a pair of wall sections 27 and 28 which bear against the rear wall 15 of the housing 5, a bottom portion 29, a side wall 30 and a pair of arms 31 and 32 which extend toward the lugs 24 and 25. Although the end faces of the arms 31 and 32 can be in planes perpendicular to the lengths of the arms 31 and 32, particularly if the end faces of the lugs 24 and 25 are not bevelled, preferably, the arms 31 and 32 have bevelled end faces 31*a* and 32*a*, the bevelling being opposite to the bevelling of the end faces 24*a* and 25*a* of the lugs 24 and 25 for the reasons set forth hereinafter. Preferably, the locking member 26 is entirely made of magnetic steel, but in any event, at least the bottom portion 29 is made of a magnetic material for completing the magnetic circuit of the remotely and electrically energizable coils 33 and 34 and causing the locking member 26 move toward the coils 33 and 34 when they are energized. The coils 33 and 34 comprise windings or coils of insulated wire covered by tape and cores 35 and 36 of magnetic material (see FIGS. 3 and 5), and the cores 35 and 36 are secured to a plate 37 of magnetic material which has as pair of ears, only one of which, 38, is shown in FIGS. 2 and 5, which fit into slots 39 and 40 (see FIG. 5) in the side wall 13 of the housing 5. The plate 37 also has an ear 37*a* which fits into a slot 40*a* in the rear wall 15. The cover 16 maintains such ears in the slots 39 and 40 when it is in place, but with removal of the cover 16, the coil assembly may be easily removed and replaced.

Biassing means in the form of compression springs 41 and 42 encircling the cores 35 and 36 act between the locking member 26 and housing 5 through the coil assembly to urge the locking member 26 upwardly, as viewed in FIGS. 1, 3 and 4, and into the position shown in these FIGS. in which position the arms 31 and 32, which have the same spacing as the lugs 24 and 25, are engageable with the lugs 24 and 25 and prevent pivoting of the keeper 4.

Figure 8:
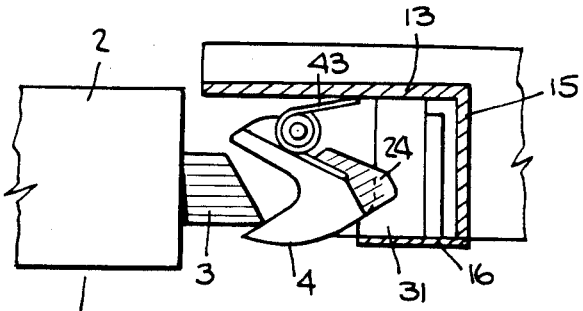

Biassing means in the form of a spring 43 (see FIGS. 6 and 8) acts between the keeper 4 and the housing side wall 13 to urge the keeper 4 into its locking position shown in FIGS. 1–5 and 6.

The embodiment of the strike illustrated in FIGS. 1–7 is of the normally locked type and is unlocked by electrical energization of the coils 33 and 34, electrical energy being supplied thereto by the wire leads 44 (see FIGS. 3 and 4) which pass through an aperture 45 in the bottom wall of the housing 5.

Figure 6:
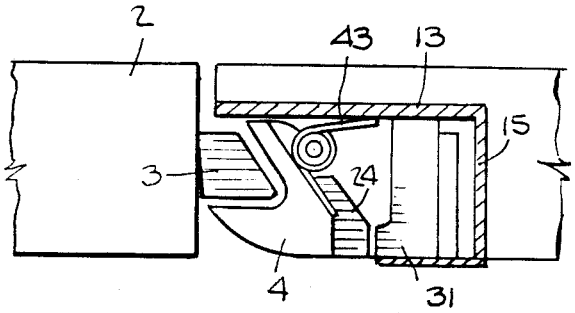
FIGS. 6 and 8 are cross-sectional plan views of the strike shown in FIG. 1 illustrating locked and unlocked positions of the locking member and the keeper.
Figure 7:
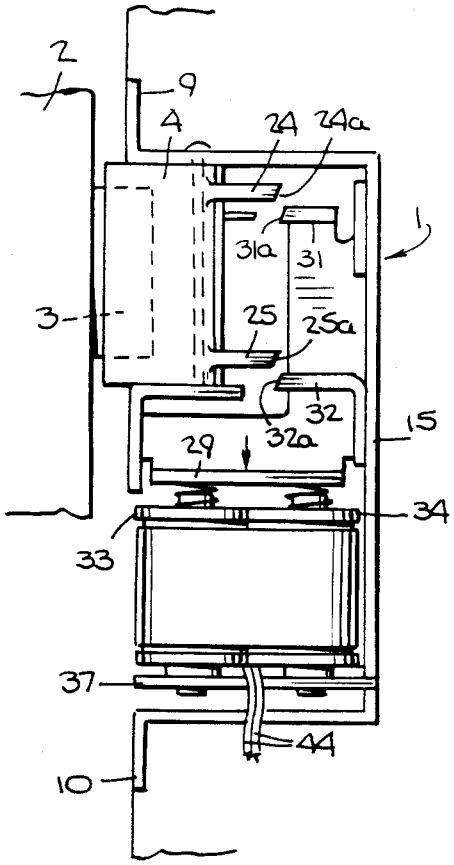
FIG. 7 is a side elevation view of the strike shown in FIG. 1 with the locking member in its unlocked position.

Accordingly, as long as the locking member 26 is in its upper, keeper locking position, the door 2 is prevented from opening, but when the coils 33 and 34 are electrically energized, the locking member 26 slides rectilinearly in the downward direction to a keeper unlocking position, as illustrated in FIG. 7. In the latter position, the keeper 4 is free to pivot because the arms 31 and 32 are out of the paths of movement of the lugs 24 and 25, the movement of the keeper 4 and its lugs being shown in FIGS. 6 and 8. In FIG. 6, the keeper 4 is locked, and in FIG. 8, the keeper 4 is unlocked.

Of course, when energization of the coils 33 and 34 is discontinued, the keeper 4 is moved into its locking position by the spring 43 and the locking member 26 is moved into its locking position by the springs 41 and 42.

It will be observed that when pressure is applied to the door 2 to open it, the latch 3 applies a pivoting force to the keeper 4 urging it toward its unlocking position. If the locking member 26 is in its locking position, such force is applied to the arms 31 and 32 by way of the lugs 24 and 25 and thence, to the rear wall 15 of the housing 5. The arms 31 and 32 can be relatively sturdy and are subject to only small bending forces, and therefore, the locking member 26 can withstand relatively high forces applied thereto by a person attempting to force the door 2 open.

While the end faces 24*a* and 25*a* and the end faces 31*a* and 32*a* can be perpendicular to the lengths of the lugs 24 and 25 and the arms 31 and 32, and hence, parallel to the pivot axis of the keeper 4, if a relatively large force is applied to the door 2 in the opening direction, the pulling force of the coils 33 and 34 can be insufficient to move the locking member 26. To aid in causing the locking member 26 to move its unlocking position with such a force, without significantly reducing the ability of the locking member 26 to resist relatively large door forces, the end faces 24*a*, 25*a*, 31*a* and 32*a* preferably are oppositely bevelled at an angle, such as 10°, but not more than 15°, as indicated in the drawings.

While a single coil could be used in the strike of the invention, such as by omitting one of the coils 33 or 34 and centering the remaining coil with respect to the magnetic portion 29 of the locking member 26, the use of two coils 33 and 34 provides, in the arrangement shown, an improvement in the pulling force exerted on the locking member 26 over what one would expect from merely using two coils or increased energization of a coil. This result is apparently due to the magnetic circuit provided by the structure shown, it being observed that the magnetic circuit is relatively short and is by way of the plate 37 and the magnetic portion 29 and not solely by way of the walls of the housing 5. Furthermore, since the movement of the locking member 26 can be relatively small due to the fact that the lugs 24 and 25 and the arms 31 and 32 can have a small thickness, the magnetic portion 29 can be relatively close to the ends of the cores 35 and 36 in the locking position of the locking member 26.

It will be observed that the strike of the invention has only one moving part for locking and unlocking the keeper 4. Also, it will be observed that the upper end of the wall section 27 abuts the inner surface of the top wall 7 of the housing 5 (see particularly FIG. 3) and is maintained in such position, in the absence of energization of the coils 33 and 34, by the springs 41 and 42. Accordingly, gravity is not relied upon to position the locking member 26 so that the strike of the invention can be used in any desired orientation.

Since only one moving part is required for locking and unlocking of the keeper 4 and whether the keeper 4 is normally locked or unlocked depends upon the positions of the arms 31 and 32 on the locking member 26, it is a simple matter to change the strike from one in which the keeper 4 is normally locked to one in which the keeper 4 is normally unlocked bY either substituting a locking member with its arms differently positioned or by making the arms adjustable.

Figure 9:
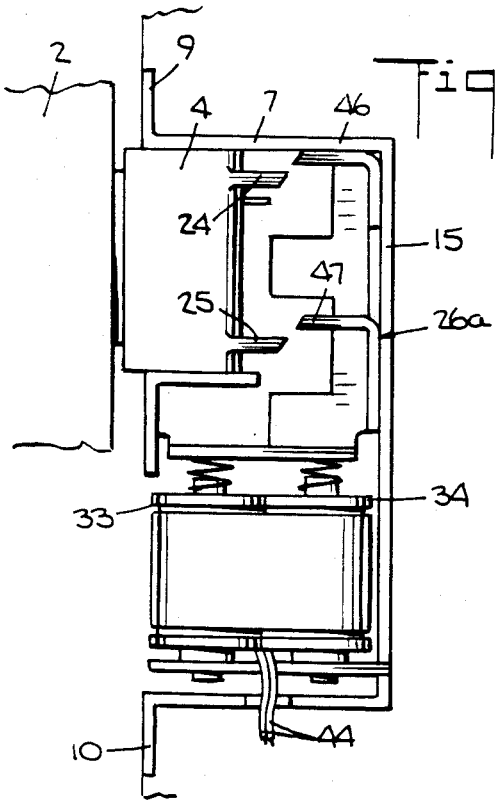
FIGS. 9 and 10 are side elevation views of an alternative embodiment of the locking member with the locking member in, respectively, unlocked and locked positions.
Figure 10:
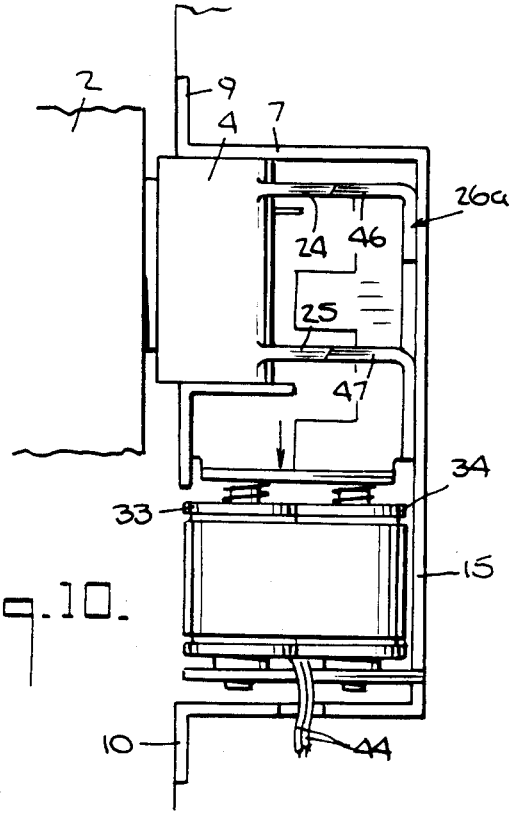
Figure 11:
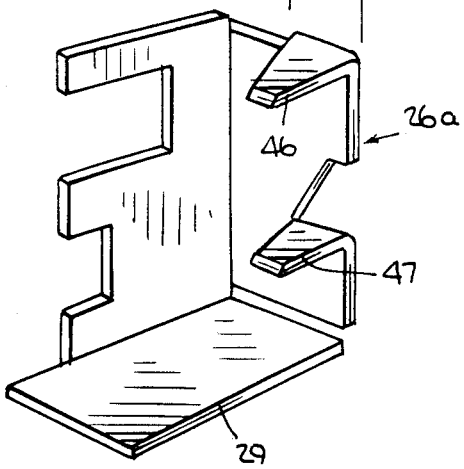
FIG. 11 is a perspective view of the locking member shown in FIGS. 9 and 10.

FIGS. 9, 10 and 11 illustrate a locking member **26*a* having arms 46 and 47 positioned thereon so that when the locking member 26*a* abuts the top wall 7, as shown in FIG. 9, the arms 46 and 47 are out of the path of movement of the lugs 24 and 25. When the coils 33 and 34 are energized, the locking member 26*a* is pulled into its locking position shown in FIG. 10, in which position, the arms 46 and 47 can engage the lugs 24 and 25 and prevent pivoting of the keeper 4**.

It will be observed from a comparision of FIGS. 5 and 11 that in addition to the positioning of the arms 46 and 47, the locking member **26*a* differs from the locking member 26 in other features. However, the locking member 26*a* can, except for the positioning of the arms 46 and 47, be of the same structure as the locking member 26 or the locking member 26 can be of the same structure as the locking member 26*a* except for the positioning of the arms 24 and 25 relative to the end of the locking member which abuts the top wall 7**.

Figure 12:
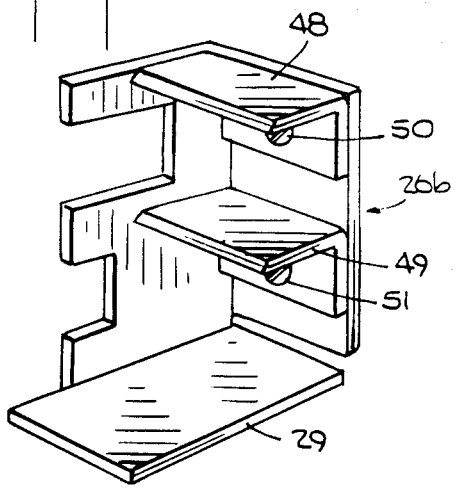
FiGS. 12, 13 and 14, are, respectively, perspective front elevation and side elevation views of a further embodiment of the locking member.
Figure 13:
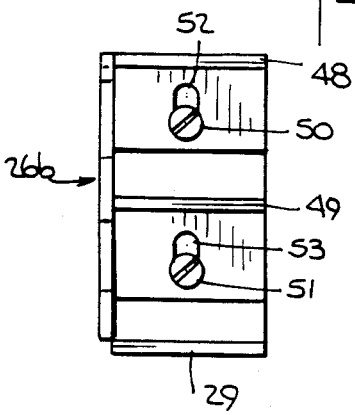
Figure 14:
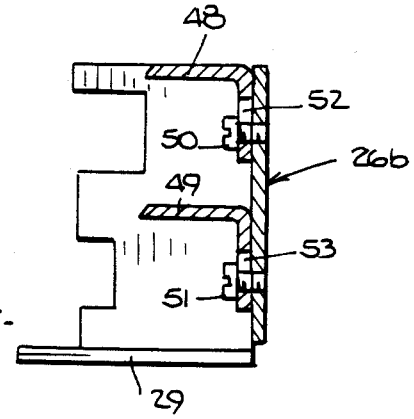

FIGS. 12–14 illustrate an embodiment of a locking member with arms 48 and 49 which can be adjusted so that the keeper 4 is either normally locked or normally unlocked The locking member **26*b* shown in FIGS. 12–14 has the arms 48 and 49 secured thereto, such as by screws 50 and 51, which extend through slots 52 and 53 in the arms 48 and 49. Thus, the arms 48 and 49 can be held in the positions shown in FIGS. 12–14 by the screws 50 and 51, which positions correspond to the normally unlocked condition of the keeper 4. However, by loosening the screws 50 and 51 and moving the arms 48 and 49 downwardly, as viewed in FIGS. 12–14, and then, tightening the screws 50 and 51, the arms 48 and 49 can be secured in positions which correspond to the positions of the arms 31 and 32 and hence, the normally locked condition of the keeper 4**.

Figure 15:
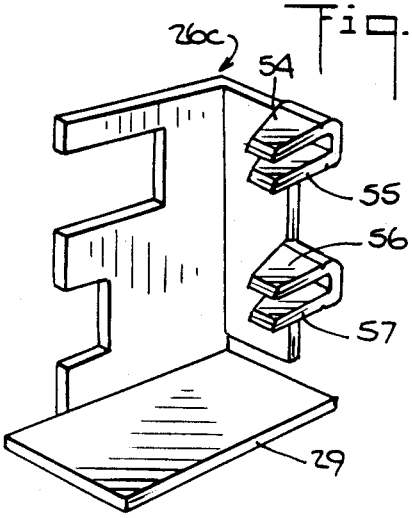
FIGS. 15 and 16 are, respectively, perspective and side elevation views of a further embodiment of the locking member.
Figure 16:
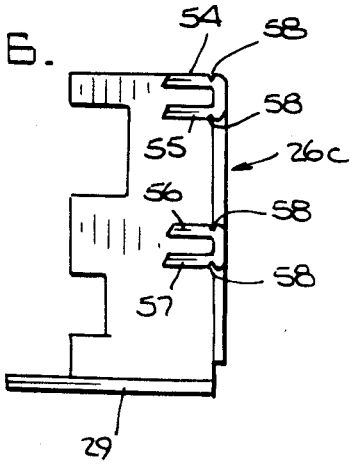

Another embodiment of a single locking member which can be used for normally locking or unlocking the keeper 4 is illustrated in FIGS. 15 and 16. The locking member **26*c* shown in these figures has four arms 54, 55, 56 and 57, arms 54 and 56 having positions corresponding to the positions of the arms 46 and 47 and arms 55 and 57 having positions corresponding to the positions of the arms 31 and 32. Each of the arms 54–57 has a line of weakening 58 (see FIG. 16) so that by bending an arm transversely to its length and at the line 58, such as with pliers, any arm can be removed. For example, if it is desired to have the keeper 4 be normally unlocked, the arms 55 and 57 would be removed leaving the arms 54 and 56 in place. Similarly, if it is desired to have the keeper 4 normally locked, the arms 54 and 56 would be removed leaving the arms 55 and 57** in place.

Accordingly with the embodiments of the locking member illustrated in FIGS. 12–16, it is necessary to manufacture only a single locking member which can be used to provide a strike with a keeper which is either normally locked or normally unlocked. If it is not known whether the strike will be installed with a normally locked or a normally unlocked keeper, it is unnecessary to supply a strike with two locking members **26*a* and 26*b* or to stock two strikes, one with a locking member 26*a* and one with a locking member 26*b***.

It will be apparent to those skilled in the art that various modifications of the invention may be made. For example, the arms of the locking member may be held in a fixed position and the keeper may be moved rectilinearly by the coil. Also, instead of pivoting, the keeper can slide toward and away from the latch and be permitted or prevented from so sliding by the arms of the slidable locking member. In addition, although not preferred, one of the arms on the locking member, e.g. 31 or 32 or 46 or 47, and the corresponding lug on the keeper 4 may be omitted.

Furthermore, although the preferred embodiment comprises a pair of coils 33 and 34 with fixed cores 35 and 36 which are energizable from outside the housing for moving the locking member, it will be apparent that such cores and coils can be replaced by a different type of locking member actuating means such as a solenoid with a movable armature pivotally connected to the locking member or an air operable piston and cylinder assembly with the piston pivotally connected to the locking member. The coils 33 and 34 are preferred because of their simplicity and because no mechanical connection to the locking member is required.

Although preferred embodiments of the present invention have been described and illustrated, it will be apparent to those skilled in the art that various modifications may be made without departing from the principles of the invention.

We claim:

1. A strike comprising:

a housing with a plurality of walls;

a keeper mounted on said housing for movement from a first position to a second position for respectively engaging a latch and moving away from the latch, said keeper having at least one lug extending therefrom toward a wall of said housing and movable along a predetermined path in a plane with movement of said keeper;

a locking member slidable mounted on said housing intermediate said keeper and said wall of said housing and movable rectilinearly in the direction transverse to said plane and said predetermined path of movement of said lug, said locking member having at least one arm thereon extending toward said lug, transversely of and away from aid wall and transversely to the direction of sliding movement of said locking member, said arm being engageable with said lug in one position of said locking member relative to said keeper for preventing movement of said keeper and said arm being out of the path of movement of said lug when said locking member is in another position relative to said keeper;

biassing means acting between said locking member and said housing and urging said locking member into one of the relative positions thereof; and locking member actuating means for moving said locking member from the last-mentioned said one relative said position thereof into the other relative position thereof.

2. A strike as set forth in claim 1 wherein said locking member actuating means is an electrically energizable coil and said locking member has a magnetic portion adjacent but spaced from said coil which is urged toward said coil by the magnetic field thereof when said coil is electrically energized.

3. A strike as set forth in claim 2 wherein said biassing means is intermediate said magnetic portion and said coil.

4. A strike as set forth in claim 3 wherein said locking member actuating means comprises a pair of wire coils in laterally spaced relation and a pair of magnetic cores, one core within one of said coils and the other core within the other of said coils and wherein said magnetic portion of said locking member extends from adjacent one of said cores to adjacent the other of said cores.

5. A strike as set forth in claim 1 wherein said housing has a wall extending in a plane substantially perpendicular to the length of said arm and said locking member is in contact with said wall of said housing.

6. A strike comprising:

a housing;

a keeper pivotally mounted on said housing for pivotal movement around an axis from a first position to a second position for respectively engaging a latch and moving away from the latch, said keeper having two lugs extending therefrom transversely to said axis and spaced from each other in the direction of said axis by a predetermined distance;

a locking member mounted on said housing for rectilinear sliding movement in the direction substantially parallel to said axis, said locking member having two arms thereon, each arm extending, respectively, toward one of said lugs and being engageable with the respective one of said lugs in one position of said locking member relative to said keeper for preventing movement of said keeper and being out of the paths of movement of said lugs when said locking member is in another position relative to said keeper, and one of said arms being spaced from the other of said arms by said predetermined distance;

biassing means acting between said locking member and said housing and urging said locking member into one of the relative positions thereof; and locking member actuating means for moving said locking member from the last-mentioned said one relative said position thereof into the other relative position thereof.

7. A strike comprising:

a housing, said housing having a front wall, a rear wall spaced from said front wall and a top wall extending from said front wall to said rear wall;

a keeper pivotally mounted at said front wall for pivotal movement around an axis substantially parallel to said rear wall for movement from a first position to a second position for respectively engaging a latch and moving away from the latch, said keeper having two lugs thereon extending therefrom toward said rear wall but terminating in spaced relation to said rear wall, said lugs being spaced from each other in the direction of said axis by a predetermined distance;

a locking member mounted in said housing for rectilinear sliding movement substantially parallel to said axis, said locking member being mounted intermediate said front wall and said rear wall and slidably abutting said rear wall, said locking member having two arms spaced from each other by said predetermine distance and extending, respectively, toward one of said lugs, said locking member being slidable between one position and another position, said arms being engageable with said lugs in one position of said locking member to prevent pivoting of said keeper and being out of the paths of movement of said lugs with pivoting of said keeper in the other position of said locking member to permit pivoting of said keeper;

biassing means acting between said locking member and said housing for urging said locking member into a position fixed in relation to said top wall; and locking member actuating means mounted at the side of said locking member opposite from said top wall for pulling said locking member from said position thereof which is fixed in relation to aid top wall toward said locking member actuating means upon energization thereof.

8. A strike comprising:

a housing with a plurality of walls;

a keeper mounted on said housing for movement from a first position to a second position for respectively engaging a latch and moving away from the latch, said keeper having at least one lug extending therefrom toward a wall of aid housing and movable along a predetermined path in a plane with movement of said keeper;

a locking member slidably mounted on said housing intermediate said keeper and said wall of said housing and movable rectilinearly in the direction transverse to said plane and said predetermined path of movement of said lug, said locking member having means thereon extending transversely to said predetermined path of movement of said lug, said means being engageable with said lug in one position of said locking member relative to said keeper for preventing movement of said keeper and said means being out of the path of movement of said lug when said locking member is in another position relative to said keeper to permit movement of said keeper;

biassing means acting between said locking member and said housing and urging said locking member into one of the relative positions thereof; and locking member actuating means for moving said locking member from the last-mentioned said one relative said position thereof into the other relative position thereof.

9. A strike as set forth in claim 6 further comprising biassing means acting between said housing and said keeper for urging said keeper into said first position thereof.

10. A strike as set forth in claim 6 wherein said lugs and said arms have interengaging surfaces which lie in planes extending at an angle of less than about 15° to said axis.

11. A strike as set forth in claim 7 wherein in said first position of said locking member said arms are engageable with said lugs.

12. A strike as set forth in claim 7 wherein in said first position of said locking member said arms are out of the paths of movement of said lugs when said keeper is pivoted.

13. A strike as set forth in claim 7 further comprising biassing means acting between said keeper and said housing and urging said keeper into said first position.

14. A strike as set forth in claim 7 wherein said locking member has a magnetic portion adjacent but spaced from said locking member actuating means, wherein said locking member actuating means comprises a pair of wire coils in laterally spaced relation and a pair of magnetic cores, one core within one of said coils and the other core within the other of said coils and wherein said magnetic portion of said locking member extends from adjacent one of said cores to adjacent the other of said cores.

15. A replacement locking member for the strike as set forth in claim 7, said replacement locking member having arms which are positioned on said replacement locking member so that in said one of said positions of said locking member, the last-mentioned said arms are out of the path of movement of said lugs when said keeper is pivoted to permit pivoting of said keeper and that in said other of said positions of said locking member said arms are engageable with said lugs to prevent pivoting of said keeper.

* * * * *

UNITED STATES PATENT AND TRADEMARK OFFICE

CERTIFICATE OF CORRECTION

PATENT NO. : 4,984,835

DATED : January 15, 1991

INVENTOR(S) : Vadacchino et al

It is certified that error appears in the above-identified patent and that said Letters Patent is hereby corrected as shown below:

Col. 1, line 18, change "3,638 984" to --3,638,984--.

Col. 5, line 29, "bY" should read --by--;

Col. 7, line 1, "aid" should read --said--;

Col. 8, line 17, "predetermine" should read --predetermined--;

Col. 8, line 41, "aid" should read --said--.

Signed and Sealed this

Thirtieth Day of June, 1992

*Attest:*

DOUGLAS B. COMER

*Attesting Officer*

*Acting Commissioner of Patents and Trademarks*